US007331195B2

(12) United States Patent
Bae et al.

(10) Patent No.: US 7,331,195 B2
(45) Date of Patent: Feb. 19, 2008

(54) REFRIGERANT DISTRIBUTION DEVICE AND METHOD

(75) Inventors: Younglib Bae, Sicklerville, NJ (US); Michael E. Heidenreich, Olive Branch, MS (US); William G. Abbatt, Dearborn, MI (US)

(73) Assignee: Advanced Heat Transfer LLC, Memphis, TN (US)

( * ) Notice: Subject to any disclaimer, the term of this patent is extended or adjusted under 35 U.S.C. 154(b) by 360 days.

(21) Appl. No.: 10/956,839

(22) Filed: Oct. 1, 2004

(65) Prior Publication Data

US 2006/0070399 A1 Apr. 6, 2006

(51) Int. Cl.
*F25B 39/02* (2006.01)
*F25B 1/06* (2006.01)
*F28F 9/02* (2006.01)

(52) U.S. Cl. ..... 62/504; 62/525; 62/500; 165/174

(58) Field of Classification Search ..... 62/504, 62/500, 525, 527, 503, 498, 515; 165/174, 165/153, 152, 175
See application file for complete search history.

(56) References Cited

U.S. PATENT DOCUMENTS 3,976,128 A 8/1976 Patel et al.
5,448,899 A 9/1995 Ohara et al.
5,651,268 A 7/1997 Aikawa et al.
5,806,586 A 9/1998 Osthues et al.
5,910,167 A 6/1999 Reinke et al.
6,449,979 B1 9/2002 Nagasawa et al.
7,086,249 B2 * 8/2006 Bae et al. ..... 62/504

FOREIGN PATENT DOCUMENTS

EP 0501736 A2 9/1992
EP 1 548 380 A2 6/2005
GB 2 366 359 A 5/2001
JP 56080599 A * 7/1981

* cited by examiner

*Primary Examiner*—Chen Wen Jiang
(74) *Attorney, Agent, or Firm*—Hodgson Russ LLP

(57) ABSTRACT

A refrigerant distribution device 10 situated in an inlet header 12 of a multiple tube heat exchanger 14 of a refrigeration system 20. The device 10 includes an inlet passage 32 that is in communication with an expansion device. Small diameter conduits 34 are disposed within the inlet header 12 and are in fluid communication with the inlet passage 32. A two-phase refrigerant fluid in the inlet passage 32 has a refrigerant liquid-vapor interface 38. The conduits 34 have inlet ports 40 that lie below the refrigerant liquid-vapor interface 38. Vapor emerging from the nozzles 34 create a homogeneous refrigerant that is uniformly delivered to the multiple tubes. The invention also includes a method for delivering a uniform distribution of a homogeneous liquid mixture of liquid and vaporous refrigerant through the heat exchanger tubes.

10 Claims, 4 Drawing Sheets

REFRIGERANT DISTRIBUTION DEVICE AND METHOD

BACKGROUND OF THE INVENTION

1. Field of the Invention

The present invention relates to a refrigerant distribution device and method for use in a refrigeration system having a compressor, condenser, expansion device, and an evaporator.

2. Background Art

In a typical air conditioning system, high-pressure liquid refrigerant from a condenser enters an expansion device where pressure is reduced. The refrigerant at the exit of the expansion device consists of a mixture of low-pressure refrigerant liquid and vapor. This mixture enters an evaporator where more of the liquid becomes vapor while the refrigerant absorbs energy from the heat exchanger as it cools the air to the conditioned space. In evaporator heat exchangers that are constructed of multiple parallel heat transfer tubes, the incoming refrigerant liquid-vapor mixture typically enters a common manifold that feeds multiple tubes simultaneously.

Due to gravity and momentum effects, the liquid refrigerant separates from the vapor refrigerant and stays at the bottom of the tube. The liquid refrigerant will proceed to the end of the manifold and feed more liquid refrigerant into the tubes at the manifold end than the tubes adjacent the inlet tube to the manifold. This results in uneven feeding of refrigerant into the heat transfer tubes of the heat exchanger, causing less than optimal utilization of the evaporator heat exchanger.

As the liquid refrigerant absorbs heat, it boils or evaporates. If some tubes have less liquid refrigerant flowing through them to boil, some parts of the heat exchanger may be under utilized if all of the liquid refrigerant boils well before the exit to the heat transfer tubes.

As the refrigerant evaporator delivers cold air, it is desirable that the temperature distribution in the emergent air flow be relatively uniform. This goal is complicated by the fact that numerous refrigerant passages may deliver non-uniform cold air.

It is known that other things being equal, a vapor phase flows in a refrigerant passage along the upper space in a horizontally oriented refrigerant distribution pipe. The liquid phase typically flows in a refrigerant passage along the lower volume of the refrigerant distribution pipe. In this way, refrigerant flow conventionally is separated. This phenomenon has complicated the task of distributing refrigerant fluid uniformly inside and along the several refrigerant passages of a refrigerant distribution system.

Another complicating factor is that the more remote the refrigerant is from an inlet side of a system including several refrigerant evaporation passages, the more difficult it is for the liquid refrigerant to flow uniformly. Conversely, the closer the refrigerant is to the inlet side, the more difficult it is for the liquid refrigerant to flow. As a result, the cooling characteristics of air passing around the refrigerant evaporation passage proximate the inlet side and that passing around distal refrigerant evaporation passages is unequal. Consequently, temperature of air passing around the refrigerant evaporation passage at the inlet side differs from that surrounding the distal refrigerant evaporation passages. This phenomenon tends to cause an uneven distribution of temperature in the emergent cold air.

A prior art search revealed the following references: U.S. Pat. No. 6,449,979; U.S. Pat. No. 5,651,268; U.S. Pat. No. 5,448,899; GB 2 366 359, the disclosures of which are incorporated here by reference.

The '979 patent mostly deals with refrigerant distribution in automotive evaporators. The idea is to control the refrigerant flow down the manifold by employing a series of progressively smaller holes. See, e.g., FIGS. 1 & 2.

The '268 patent discloses an apparatus for improving refrigerant distribution in automotive evaporators. The fundamental concept is to mix the refrigerant liquid and vapor at the evaporator inlet and control the distribution of the tubes through small holes that are located around the inlet tube. See, e.g., FIGS. 9 & 12.

The '899 patent discloses a system which separates the liquid refrigerant from the vapor at the evaporator inlet through gravity. Vapor is channeled to the evaporator outlet and only liquid refrigerant is allowed to proceed through the heat exchanger. One limitation of this approach is that the heat exchanger orientations be such that gravity separates the liquid and vapor. Additionally, this approach is most suitable for plate-type evaporators and may not function effectively in other types of evaporators.

GB 2 366 359 teaches an arrangement of four heat exchanger sections which controls refrigerant flow such that it balances the refrigerant heat transfer. However, there is a non-uniform refrigerant distribution in each section which impedes efficient utilization of the heat exchanger.

SUMMARY OF THE INVENTION

One object of the invention is to provide the heat transfer tubes in a heat exchanger with a homogeneous mixture of liquid and vapor refrigerant which will provide uniform feeding of refrigerant. The result will be uniform utilization of the evaporator heat exchanger.

The invention encompasses a refrigerant distribution device that is located in an inlet header of a multiple tube heat exchanger of a refrigeration system. Conventionally, the system has an expansion device means that delivers a two-phase refrigerant fluid to the inlet header. The multiple tube heat exchanger also has an outlet header that delivers a refrigerant fluid that is substantially in a vapor state. A plurality of tubes lie in fluid communication between the inlet and outlet headers.

The refrigerant distribution device includes an inlet passage that in the preferred embodiment extends substantially along and within the inlet header. The inlet passage is in communication with the evaporator. If the system has an expansion device means, the two-phase refrigerant fluid in the inlet passage has a refrigerant liquid-vapor interface below which the fluid is predominantly in the liquid phase and above which the fluid is predominantly in the vapor phase.

One or more small diameter conduits (up to 5 mm in diameter; preferably up to 1.5 mm in diameter, depending on flow rate and size of the heat exchanger) terminating in nozzles are disposed within the inlet header. The conduits are in fluid communication with the inlet passage.

Each small diameter conduit has a liquid inlet port positioned below the refrigerant liquid-vapor interface. Refrigerant flow into the inlet tube and a pressure difference between the inlet tube and the outlet header urge a fluid flow through the small diameter conduits. A first riser section of the small diameter conduits extends upwardly from below the liquid-vapor interface to a position outside the inlet passage but within the inlet header. There is a sealing engagement between the conduit and the outer surface of the inlet passage. Within the annular space between the inlet passage and the inlet header, the conduits extend outside the inlet passage. The nozzles in which the conduits terminate are positioned outside the inlet passage. The emergent fluid is a homogeneous mixture of liquid and vaporous refrigerant to be delivered relatively uniformly through the heat exchanger tubes for efficient distribution of the refrigerant fluid.

The invention also encompasses a method for distributing a homogeneous mixture of liquid and vaporous refrigerant to the heat exchanger tubes using the disclosed refrigerant distribution device.

DETAILED DESCRIPTION OF THE PREFERRED EMBODIMENT(S)

Figure 1:
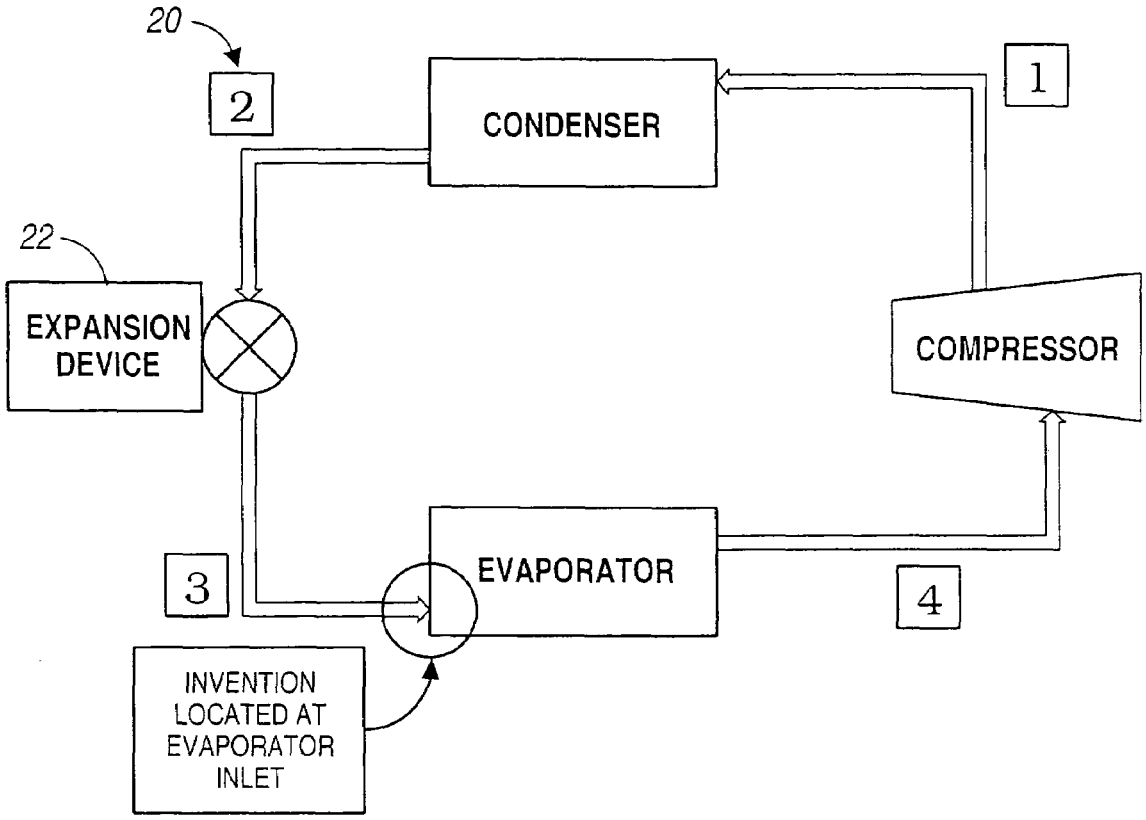
FIG. 1 is a schematic illustration of the main components of a refrigeration system and shows where the invention is situated.

Turning first to FIG. 1, there are depicted the major components of a refrigeration system. This figure is useful in illustrating the positioning of the invention in relation to conventional components. It will be appreciated that the term "refrigeration cycle" is a generic term which describes a vapor compression cycle that is used in both air conditioning and low temperature refrigeration systems.

In FIG. 1, the compressor adds energy to a refrigerant by compressing it to a high pressure. The refrigerant enters a condenser along passage (1) as a high temperature vapor. The condenser typically rejects energy to a heat sink—usually ambient air. Upon emergence from the condenser as a high pressure subcooled liquid (2), the refrigerant flows through an expansion (throttling) device. This device reduces the pressure of the refrigerant. On leaving the expansion device, the refrigerant exists in two phases: primarily liquid (about 80%); and some vapor (about 20%) in passage (3). This two-phase refrigerant then enters the evaporator. There, it absorbs energy and provides a cooling effect. In most cases, as the fluid evaporator continues to absorb energy, the refrigerant evaporates or boils. The system is designed to completely evaporate all of the refrigerant, providing low pressure superheated gas back to the compressor (4). In FIG. 1, the invention disclosed herein is located at the evaporator inlet.

Usually, the fluid being cooled is air. However, the fluid to be cooled may also be a liquid—such as water.

Figure 2:
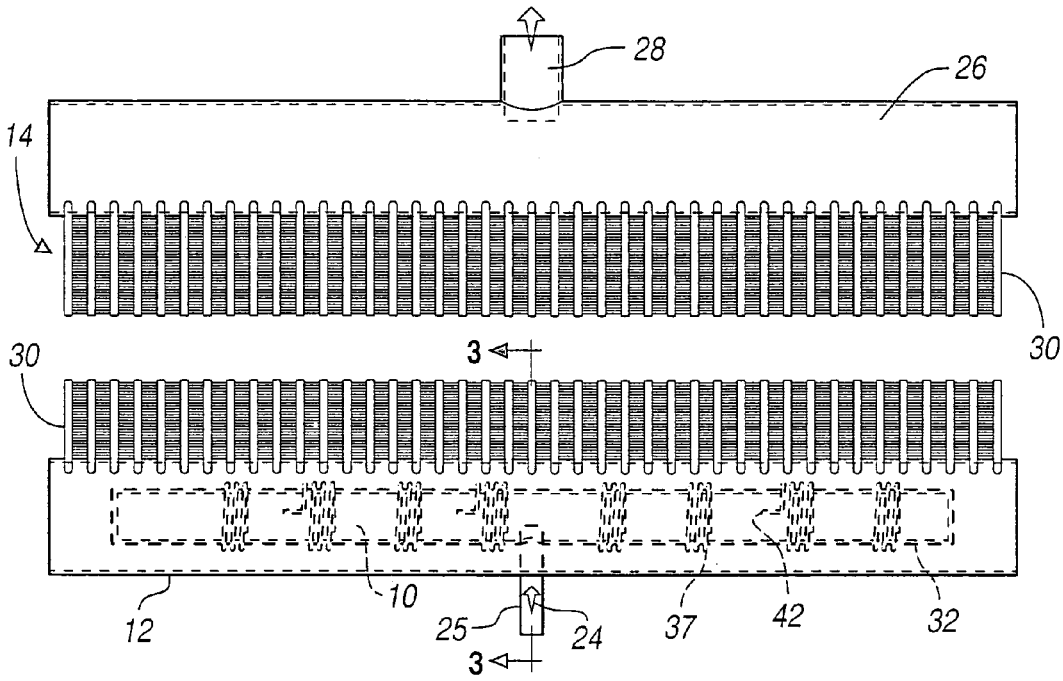
FIG. 2 is a sectioned view of a multiple tube heat exchanger with an inlet header that houses the invention.
Figure 3:
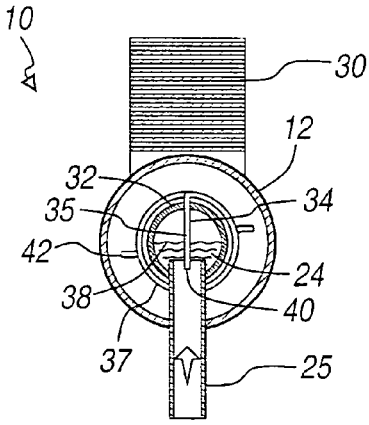
FIG. 3 is a sectioned view of the inlet header taken along the line B-B of FIG. 2.

Turning now to FIGS. 1-3, there is depicted a refrigerant distribution device 10 in an inlet header 12 of a multiple tube heat exchanger 14 of a refrigeration system 20. Optionally, the system has an expansion device means 22 (FIG. 1) that delivers a two-phase refrigerant fluid 24 (FIGS. 2-3) to an inlet port 25 of the inlet header 12. FIG. 2 depicts an embodiment of the invention wherein the inlet port 25 of the inlet header 12 is, preferably, located in a middle section of the inlet header 12 for more uniform distribution of incoming refrigerant laterally and axially along the inlet header 12. Although one inlet port 25 is depicted in FIGS. 2-3, it will be appreciated that multiple inlet ports 25 may duct incoming refrigerant to the inlet passage 32. Typically, the multiple tube heat exchanger also has an outlet header 26 (FIG. 2) that delivers a cool refrigerant fluid 28 through outlet ports that is substantially in a vapor state. Although depicted in FIGS. 3 and 5 as having a circular cross-section, either or both of the headers may have a cross-section that is elliptical or oval, and may or may not be symmetrical about an equatorial plane. As is known, multiple tubes 30 lie in fluid communication between the inlet and outlet headers 12, 26.

The refrigerant distribution device 10 includes an inlet passage 32 (FIGS. 2,3) that (in the embodiment shown) extends substantially along and within the inlet header 12. Optionally, the inlet passage 32 is in communication with the expansion device means 22, such as a valve. One or more small diameter conduits 34 are disposed within the inlet header 12 that are in fluid communication with the inlet passage 32.

Figure 5:
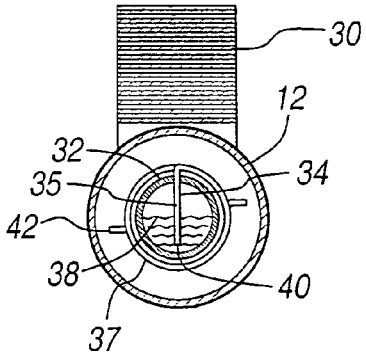
FIG. 5 is a sectioned view thereof taken along the line A-A of FIG. 4.

The two-phase refrigerant fluid in the inlet passage 32 has a refrigerant liquid-vapor interface 38 (FIGS. 3 and 5). Below the refrigerant liquid-vapor interface 38, the fluid is predominantly in a liquid phase. Above the refrigerant liquid-vapor interface 38, the fluid is predominantly in a vapor phase. If the system lacks an expansion device means 22, the two-phase refrigerant fluid in the inlet passage 32 is predominantly in the liquid phase.

The one or more small diameter conduits 34 have inlet ports 40 that lie below the refrigerant liquid-vapor interface 38. The conduits 34 include riser portions 35 that lead away from the inlet ports 40 and extend through the wall of the inlet passage 32. A sealing engagement is provided between the risers 35 and the wall of the inlet passage 32. As the refrigerant enters the inlet ports 40 and flows through the risers 35 outwardly from the inlet passage 32, the refrigerant enters sections 37. The sections 37 are in the embodiment depicted as helical. They extend around the outside of the inlet passage 32. In another embodiment (depicted in FIGS. 6-7, to be described later), the sections 37 extend axially or longitudinally. After a number of turns, in the helical embodiment, the sections 37 terminate in nozzles 42 through which refrigerant is dispersed as a consequence of hydrodynamic pressure. The refrigerant then permeates an annular space between the inlet manifold 12 and the inlet passage 32 before delivery under a relatively uniform pressure and flow rate into the tubes 30.

Pressure exerted by refrigerant flow into the inlet passage 32 and a pressure difference between the inlet passage 32 and the outlet header 26 urge a refrigerant flow through the conduits 34 with a vapor flow exiting through the one or more small diameter nozzles 42. In this way, there is created a homogeneous mixture of liquid and vaporous refrigerant to be delivered relatively uniformly via the inlet header 12 through the tubes 30 to the outlet header 26 for efficient distribution of the refrigerant fluid.

In the embodiment shown in FIG. 2, there are multiple pairs of small diameter conduits 34 and associated sections 37. Adjacent pairs have nozzles 42 that are oriented on opposite sides of the inlet passage 32 to provide uniform delivery of the refrigerant.

The invention also encompasses a method for delivering a homogeneous mixture of liquid and vaporous refrigerant relatively uniformly through the multiple tubes of a heat exchanger 14 with an inlet header 12. The method comprises the steps of:

providing an inlet passage 32 within the inlet header 12, the inlet passage 32 being in communication with an expansion device means;

disposing one or more small diameter conduits 34 within the inlet header 12 that are in fluid communication with the inlet passage 32;

delivering a refrigerant fluid to the inlet passage so that a refrigerant liquid-vapor interface 38 is created therein below which the fluid is predominantly in a liquid phase and above which the fluid is predominantly in a vapor phase;

submerging the one or more capillary liquid inlet ports of the conduits so that they lie below the refrigerant liquid-vapor interface; and pressurizing refrigerant flow into the inlet passage so that a liquid flow is urged through the capillary conduits so that upon emergence from nozzles located outside the inlet passage, there is created a homogeneous mixture of liquid and vaporous refrigerant to be delivered relatively uniformly through multiple tubes to the outlet header for efficient distribution of the refrigerant fluid.

In FIG. 3, if there is an expansion device means 22 in the system, the refrigerant liquid-vapor interface 38 lies at an elevation that tends to rises with the distance away from an inlet port 25 of the inlet passage 32. It will be appreciated that conventionally the refrigerant inlet port 25 may be located toward either end of the inlet header 12 or intermediate therebetween. Depending on where it is located within the heat exchanger inlet header 12, some of the heat exchanger tubes 30 may receive all liquid, some are vapor, and some a mixture. Thus, the disclosed invention avoids what would otherwise be an ineffective use of the heat exchanger.

The definition of refrigerant in this disclosure includes any fluid/chemical where the fluid will be in liquid and vapor states when flowing through the evaporator. As the refrigerant absorbs energy, it continually boils (evaporates), eventually the entire volume of refrigerant, becoming vapor. It is the changing of phases and the heat of vaporization which characterizes vapor compression refrigeration systems.

There are hundreds of chemicals which can be classified as refrigerants, but the following lists the most common:

HCFC-22 (used in the large majority of air conditioning systems);

HFC-134a (used in automobile air conditioners, vending machines and home refrigerators);

HFC-404A (used in commercial refrigeration systems); and

HFC-410A (used in air conditions and is a designated replacement for HCFC-22).

HCFC is a hydrochlorofluorocarbon. A refrigerant fluid such as HCFC-22 is used in the majority of air conditioners today. HCFC-22 (R22) consists of chlorodifluoromethane. R22 is a single component HCFC refrigerant with a low ozone depletion potential. It is used for air conditioning and refrigeration applications in a variety of markets, including appliance, construction, food processing, and supermarkets. Freon® is a trade name for a group of chlorofluorocarbons used primarily as refrigerants. Freon® is a registered trademark belonging to E.I. du Ponte de Nemours & Company.

Typical temperatures and pressures with HCFC-22 at the 4 state points in the refrigeration cycle (FIG. 1) are:

1. 260 psig, 180° F., superheated vapor
2. 250 psig, 100° F., subcooled liquid
3. 81 psig, 48° F. two phase liquid & vapor
4. 75 psig, 60° F. superheated vapor.

Less common and/or future refrigerants are:

Carbon dioxide (a longer term replacement for many of the above refrigerants);

Ammonia (used in larger cold storage refrigeration systems);

Iso-butane and propane (used in small refrigeration systems in Europe); and

Water (can also be used as a two-phase refrigerant).

Figure 4:
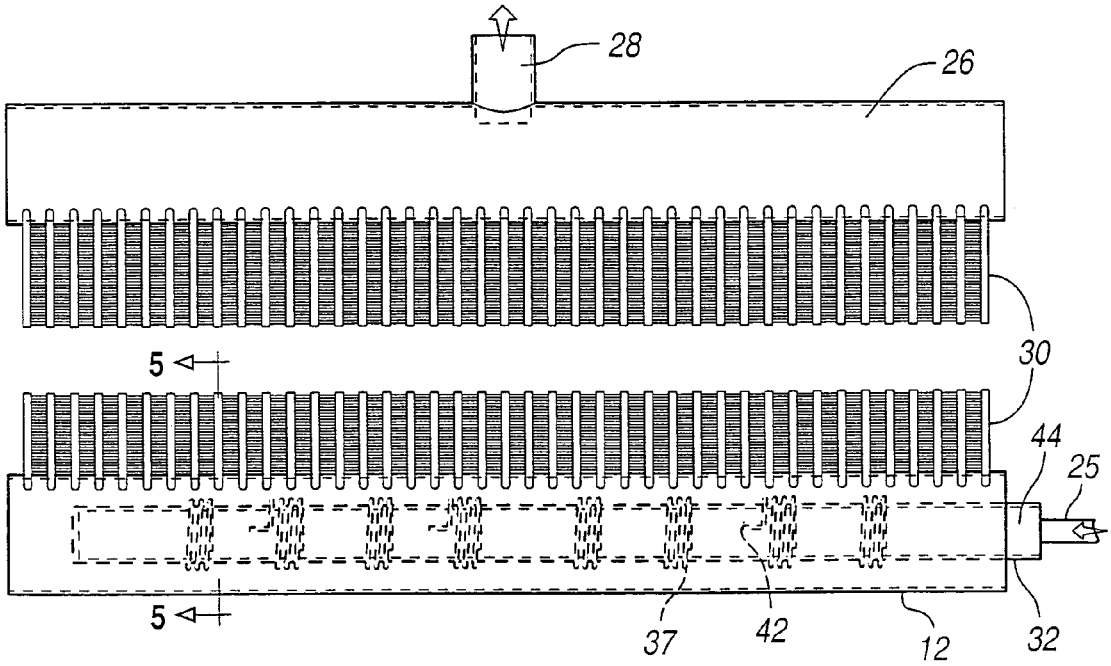
FIG. 4 is a sectioned view of a multiple tube heat exchanger with an alternate embodiment of an inlet header that houses the invention.

FIGS. 4-5 depict an alternate embodiment of the invention. In that embodiment, the inlet passage 32 has a terminal portion 44 that lies outside the inlet manifold 12.

The inventors have observed the diameters of various conduits in relation to their length. They have concluded that good results are obtained with an average ratio of length to conduit internal diameter is between 25 and 1000.

In the embodiment with helical sections 32, it will be appreciated that the number of turns (N) of a given helical section of the conduit may be varied to suit the needs of a particular application. For most applications, about 2-3 turns are preferred.

It should also be appreciated that in the orientation shown in FIGS. 2-5 reflect a system that lies in a generally horizontally position. The system could also function, albeit suboptimally in other orientations which are less gravity-dependent.

If there is an expansion device means in the refrigerant system, the physical characteristics of refrigerant as it flows through the inlet 40, along the riser 35, and outwardly through the section 37 before emergence at the nozzle 42 is a mixture of liquid droplets and vapor. Not wishing to be bound by any particular theory, the predominant phase change to the vapor state occurs closer toward the nozzle end 42 of the conduit 34 than at the inlet end 40.

If desired, the nozzle at the distal end of the conduit 34 from which vapor emerges can be defined by various geometries. These include an end perpendicular to the longitudinal axis of the conduit, or a constricted or pinched section. Clearly, the constriction should not be such as to adversely affect a desired flow capacity under prevailing conditions of temperature and pressure.

Figure 6:
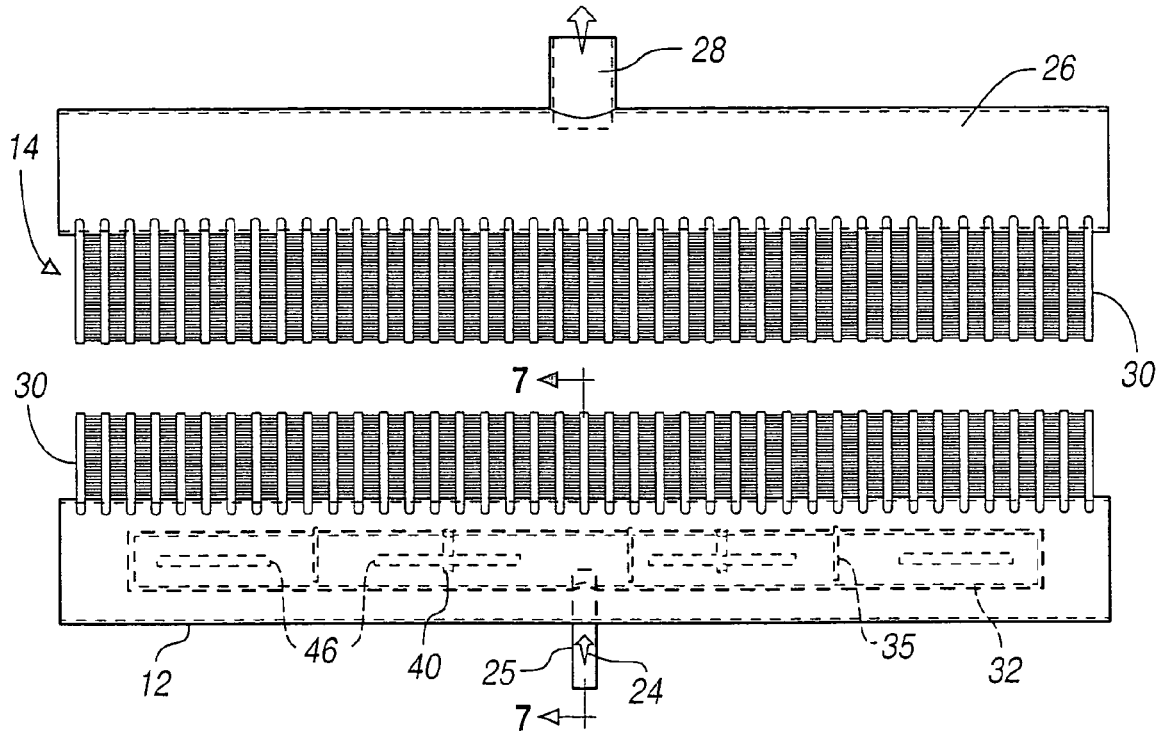
FIG. 6 is a section view of a multiple tube heat exchanger with an inlet header that houses an alternate embodiment of the invention.
Figure 7:
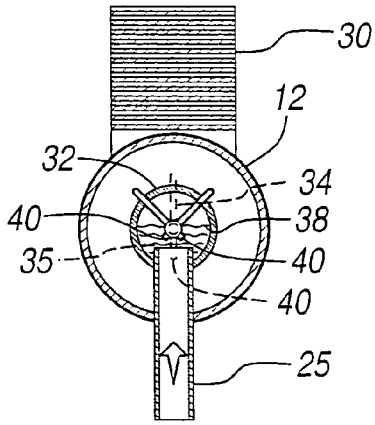
FIG. 7 is a sectioned view thereof taken along the line A-A of FIG. 6.

Turning now to FIGS. 6-7, there is depicted an alternate embodiment of the invention. In that embodiment, there are multiple risers 35 (FIG. 7). The inlet ports 40 lie within a refrigerant that is at least partially in liquid form. The risers extend outwardly through a wall of the inlet passage 32 before terminating in axially extending lengths 46. These lengths 46 terminate in closed ends and are provided with pores (not shown). These pores are distributed along the axially extending lengths 46 in much the same way as a soaker hose is deployed in a garden to provide a distribution of water for irrigation purposes. Similarly, the pores allow refrigerant fluid to be distributed from the inlet passage 32 radially outwardly through the risers 40.

In FIG. 6, the risers that are located in a central part of the inlet passage 32 terminate in T-configured axially extending lengths 46. In FIG. 7, the risers 35 extend outwardly from the inlet passage 32 in a configuration that resembles the quadrants of a compass: for example, oriented to the NW, N, or NE.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A refrigerant distribution device in an inlet header of a multiple tube heat exchanger of a refrigeration system, the system delivering a refrigerant fluid to at least one of the inlet headers, the multiple tube heat exchanger having one or more outlet headers that deliver a cooled refrigerant fluid that is substantially in a vapor state and multiple tubes in fluid communication between the inlet and outlet headers;

the refrigerant distribution device including an inlet passage located at least partially within the inlet header; and one or more small diameter conduits within at least one of the inlet headers in fluid communication with the inlet passage;

each conduit having a liquid inlet port and a nozzle;

the refrigerant flow into the inlet passage introducing liquid and vapor through a common tube and forcing flow though the one or more conduits so that effluent from the nozzles comprises a homogeneous mixture of refrigerant in liquid and vapor phases extending over substantially the entire length of the inlet header to be delivered relatively uniformly through the multiple tubes to the outlet header for efficient distribution of the refrigerant fluid.

2. The refrigerant distribution device of claim 1 wherein the inlet passage extends substantially along and within the inlet header.

3. The refrigerant distribution device of claim 1 wherein the inlet passage includes a portion that extends outwardly from the inlet header.

4. The refrigerant distribution device of claim 1 wherein the one or more conduits include a riser that extends outwardly from the inlet passage and an axial branch extending longitudinally from the riser, the axial branch including pores defined therein through which the refrigerant is propagated into a space between the inlet passage and the inlet header.

5. A refrigerant distribution device in an inlet header of a multiple tube heat exchanger of a refrigeration system, the system delivering a refrigerant fluid to at least one of the inlet headers, the multiple tube heat exchanger having one or more outlet headers that deliver a cooled refrigerant fluid that is substantially in a vapor state and multiple tubes in fluid communication between the inlet and outlet headers;

the refrigerant distribution device including an inlet passage located at least partially within the inlet header; and one or more small diameter conduits within at least one of the inlet headers in fluid communication with the inlet passage;

each conduit having a liquid inlet port and a nozzle;

the refrigerant flow into the inlet passage forcing flow through the one or more conduits so that effluent from the nozzles comprises a homogeneous mixture of refrigerant extending over substantially the entire length of the inlet header to be delivered relatively uniformly through the multiple tubes to the outlet header for efficient distribution of the refrigerant fluid wherein the one or more conduits includes riser that extends outwardly from the inlet passage and a helical section extending from the riser, the helical section encircling the inlet passage around an outside surface thereof.

6. The refrigerant distribution device of claim 5 including multiple pairs of conduits, wherein the nozzles of adjacent pairs are positioned at opposite surfaces of the inlet passage.

7. The refrigerant device of claim 5 wherein the helical section has an internal diameter (D) and a length (L) wherein the ratio of L to D is between 25 and 1000.

8. An inlet header of a multiple tube heat exchanger of a refrigeration system, the system having an expansion device means that delivers a two-phase refrigerant fluid to the inlet header, the multiple tube heat exchanger having an outlet header that delivers a cooled refrigerant fluid that is substantially in a vapor state; and multiple tubes in fluid communication between the inlet and outlet headers, the inlet header having a refrigerant distribution device including an inlet passage located at least partially within the inlet header; and one or more small diameter conduits within at least one of the inlet headers in fluid communication with the inlet passage;

each conduit having a liquid inlet port and a nozzle;

the refrigerant flow into the inlet passage introducing liquid and vapor through a common tube and forcing flow through the one or more conduits so that effluent from the nozzles comprises a homogeneous mixture of refrigerant, in liquid and vapor phases extending over substantially the entire length of the inlet header to be delivered relatively uniformly through the multiple tubes to the outlet header for efficient distribution of the refrigerant fluid.

9. A multiple tube heat exchanger with a refrigerant distribution device in an inlet header of the heat exchanger, the multiple tube heat exchanger having an outlet header that delivers a cooled refrigerant fluid that is substantially in a vapor state and multiple tubes in fluid communication between the inlet and outlet headers, the refrigerant distribution device including an inlet passage introducing liquid and vapor through a common tube aud located at least partially within the inlet header; and one or more small diameter conduits within at least one of the inlet headers in fluid communication with the inlet passage;

each conduit having a liquid inlet port and a nozzle;

the refrigerant flow into the inlet passage forcing flow through the one or more conduits so that effluent from the nozzles comprises a homogeneous mixture of refrigerant in liquid and vapor phases extending over substantially the entire length of the inlet header to be delivered relatively uniformly through the multiple tubes to the outlet header for efficient distribution of the refrigerant fluid.

10. A method for providing a homogeneous mixture of refrigerant to be delivered relatively uniformly through the tubes of a heat exchanger having an inlet header, the method comprising the steps of:

positioning an inlet passage located at least partially within the inlet header; and mounting one or more small diameter conduits within at least one of the inlet headers in fluid communication with the inlet passage;

providing each conduit having a liquid inlet port and a nozzle; and urging refrigerant flow in liquid and vapor phases through a common tube into the inlet passage, thereby forcing flow through the one or more conduits so that effluent from the nozzles comprises a homogeneous mixture of refrigerant in liquid and vapor phases extending over substantially the entire length of the inlet header to be delivered relatively uniformly through the multiple tubes to the outlet header for efficient distribution of the refrigerant fluid.

* * * * *